US006955309B2

(12) United States Patent
Matthew et al.

(10) Patent No.: US 6,955,309 B2
(45) Date of Patent: Oct. 18, 2005

(54) METHOD OF DIAGNOSING AND CONTROLLING A GRINDING MILL FOR PAPER AND THE LIKE

(75) Inventors: John B. Matthew, East Haddam, CT (US); Eileen Joy, Armonk, NY (US); David Robinson, Chester, NY (US)

(73) Assignee: Norwalk Industrial Components, LLC, Manchester, CT (US)

( * ) Notice: Subject to any disclaimer, the term of this patent is extended or adjusted under 35 U.S.C. 154(b) by 126 days.

(21) Appl. No.: 10/471,251

(22) PCT Filed: Mar. 12, 2002

(86) PCT No.: PCT/US02/07380

§ 371 (c)(1),
(2), (4) Date: Sep. 10, 2003

(87) PCT Pub. No.: WO02/072310

PCT Pub. Date: Sep. 19, 2002

(65) Prior Publication Data

US 2004/0112997 A1 Jun. 17, 2004

(51) Int. Cl.[7] ..... B02C 25/00

(52) U.S. Cl. ..... 241/30; 241/261.2

(58) Field of Search ..... 241/30, 261.2, 241/261.3, 28, 33–37; 73/432.1

(56) References Cited

U.S. PATENT DOCUMENTS 3,610,541 A * 10/1971 Gudaz ..... 241/37
4,661,911 A * 4/1987 Ellery, Sr. ..... 700/128
4,943,347 A * 7/1990 Floden ..... 162/61
5,500,088 A * 3/1996 Allison et al. ..... 162/198

* cited by examiner

*Primary Examiner*—Mark Rosenbaum
(74) *Attorney, Agent, or Firm*—Patrick J. Walsh

(57) ABSTRACT

This invention relates to a method of diagnosing or controlling a grinding mill for paper pulp, wood chips, or other fibrous materials, by measuring the incremental change in power related to an incremental change in the gap, and using the ratio of the two differences, together with the measure of applied power, as the diagnostic or control parameter.

9 Claims, 6 Drawing Sheets

Figure 1
Load vs Displacement

Table I

Plastic Tubing Experiment
Load vs Displacement

Offset: 0.61

| Tons | Height | Displacement |
|---|---|---|
| 1 | 2.6 | 1.99 |
| 2 | 1.35 | 0.74 |
| 3 | 1.05 | 0.44 |
| 4 | 0.95 | 0.34 |
| 5 | 0.9 | 0.29 |
| 6 | 0.9 | 0.29 |
| 7 | 0.88 | 0.27 |
| 8 | 0.83 | 0.22 |
| 9 | 0.8 | 0.19 |
| 10 | 0.8 | 0.19 |
| 11 | 0.78 | 0.17 |
| 12 | 0.75 | 0.14 |

FIG. 1

Load vs Displacement

TABLE 2

FB FILLING

| | | |
|---|---|---|
| no-load= | 159 | kw |
| edge lgth= | 133 | km/rev= |
| D= | 38 | in. |
| d= | 22 | in. |
| RPM= | 510 | 1/min |
| X= | 15831 | |
| k1= | 3E-08 | |
| c1= | 500 | psi |
| c2= | 0.710 | |
| c3= | 0.710 | |
| re= | 0.002 | in. |

ASSUMES ZERO = 437

| motor load kw | h-wheel degrees | gap thousandths in.(x1000) | single pair kw | | dP/dg | -P/dPdg g= in.(x1000) | go in.(x1000) | Relative Stress psi | Total Net Power kw | Specific Edge Load w/m |
|---|---|---|---|---|---|---|---|---|---|---|
| 325 | 135 | 2.067222 | 63 | 107 | -51 | 2.097 | 11.155 | 2659 | 215 | 0.190 |
| 410 | 190 | 1.715278 | 128 | 131 | -76 | 1.715 | 11.155 | 3252 | 262 | 0.232 |
| 460 | 240 | 1.368056 | 151 | 164 | -120 | 1.368 | 11.155 | 4077 | 329 | 0.291 |
| 580 | 280 | 1.090278 | 211 | 206 | -189 | 1.090 | 11.155 | 5115 | 413 | 0.365 |
| 625 | 285 | 1.055556 | 233 | 213 | -202 | 1.056 | 11.155 | 5284 | 426 | 0.377 |
| 660 | 310 | 0.881944 | 251 | 255 | -289 | 0.882 | 11.155 | 6324 | 510 | 0.451 |
| 783 | 315 | 0.847222 | 312 | 266 | -313 | 0.847 | 11.155 | 6583 | 531 | 0.470 |
| 870 | 350 | 0.604167 | 356 | 372 | -616 | 0.604 | 11.155 | 9231 | 745 | 0.659 |
| 915 | 352 | 0.590278 | 378 | 381 | -646 | 0.590 | 11.155 | 9449 | 762 | 0.674 |
| 935 | 355 | 0.569444 | 388 | 395 | -694 | 0.569 | 11.155 | 9784 | 790 | 0.699 |
| 970 | 358 | 0.548611 | 406 | 410 | -748 | 0.549 | 11.155 | 10166 | 820 | 0.726 |
| 1030 | 365 | 0.500000 | 436 | 450 | -900 | 0.500 | 11.155 | 11155 | 900 | 0.796 |
| 1100 | 390 | 0.326389 | 471 | 689 | -2112 | 0.326 | 11.155 | 17088 | 1379 | 1.220 |

MD FILLING

| | | |
|---|---|---|
| no-load= | 300 | kw |
| edge lgth= | 191 | km/rev= |
| D= | 38 | in. |
| d= | 22 | in. |
| RPM= | 510 | 1/min |
| X= | 8808 | |
| k1= | 3E-08 | |
| c1= | 500 | psi |
| c2= | 0.710 | |
| c3= | 0.710 | |
| re= | 0.002 | in. |

ASSUMES ZERO = 635

| | | | | | | | | | | | |
|---|---|---|---|---|---|---|---|---|---|---|---|
| 527 | 90 | 3.784722 | 1.2616 | 38 | 40 | -32 | 1.262 | 7.107 | 2817 | 239 | 0.147 |
| 625 | 220 | 2.881944 | 0.9606 | 54 | 52 | -55 | 0.961 | 7.107 | 3599 | 314 | 0.194 |
| 655 | 255 | 2.638889 | 0.8796 | 59 | 57 | -65 | 0.880 | 7.107 | 4040 | 343 | 0.211 |
| 670 | 280 | 2.465278 | 0.8218 | 62 | 61 | -74 | 0.822 | 7.107 | 4324 | 367 | 0.226 |
| 720 | 310 | 2.258944 | 0.7523 | 70 | 67 | -89 | 0.752 | 7.107 | 4723 | 401 | 0.247 |
| 760 | 355 | 1.944444 | 0.6481 | 77 | 78 | -120 | 0.648 | 7.107 | 5482 | 466 | 0.287 |
| 790 | 375 | 1.806556 | 0.6019 | 82 | 84 | -139 | 0.602 | 7.107 | 5904 | 501 | 0.309 |
| 835 | 395 | 1.666667 | 0.5556 | 88 | 91 | -163 | 0.556 | 7.107 | 6396 | 543 | 0.335 |
| 880 | 410 | 1.562500 | 0.5208 | 93 | 97 | -185 | 0.521 | 7.107 | 6823 | 579 | 0.357 |
| 950 | 440 | 1.354167 | 0.4514 | 108 | 111 | -247 | 0.451 | 7.107 | 7872 | 669 | 0.412 |
| 1076 | 460 | 1.215278 | 0.4051 | 129 | 124 | -307 | 0.405 | 7.107 | 8772 | 745 | 0.459 |

FIG 3

Specific Edge Load vs Power

METHOD OF DIAGNOSING AND CONTROLLING A GRINDING MILL FOR PAPER AND THE LIKE

FIELD OF THE INVENTION

This invention relates to a method of diagnosing or controlling a grinding mill for paper pulp, wood chips, or other fibrous materials, by measuring the incremental change in power related to an incremental change in the gap, and using the ratio of the two differences, together with the measure of applied power, as the diagnostic or control parameter.

BACKGROUND OF THE INVENTION

In the manufacture of paper or paperboard, it is common to employ large attrition mills to grind wood chips or other fibrous raw materials to produce pulp, or to grind chemically produced wood pulp to enhance its papermaking properties. In both cases, the process is referred to as refining. These attrition mills are normally of the disk type or the conical type (or sometimes a combination of the two), where a rotor surface acts against a stator surface (or in some instances a counter-rotating surface) and causes a reduction in the size or a change in some other desirable physical properties of the material being processed. The working surfaces of these mills usually consist of a stator plate with more or less radial bars and grooves, and a rotor plate of similar form. The material being processed, often fibrous in nature, is captured between a rotor bar edge and the opposing stator or counter-rotating bar edge. It is the compression loading of the fibrous particles which acts to cause a change in the physical properties of the material being processed.

The wear surfaces of these grinding mills (called refiner plates or refiner fillings) are replaceable and may be require replacement at intervals between a few weeks and several months or more. They are usually made of cast steel but may also be fabricated or machined from solid steel blanks. During the normal course of refining of the wood chips or the pulp, it is the wearing down of the bars on the opposing surfaces which eventually leads to the need for replacement.

The most common control parameter in the refining of wood chips or pulp is the applied power. More precisely it is the net applied power that is of significance, since a certain amount of the input shaft horsepower is consumed by viscous frictional losses in the fluid which suspends the process particles (either a vapor or liquid phase). The net applied power is a measure of the amount of energy that is being applied to a given flow of process material and is referred to as the specific energy consumption (often expressed as kilowatt-hours per ton of moisture free material processed).

It is well known in the pulp and paper industry, that specific energy consumption (SEC) is not the only significant parameter that influences the quality characteristics of the material being processed. A second parameter, which reflects the magnitude of the compressive loads applied to the fibrous particles, should also be significant. This second parameter is called refining intensity. There has not previously been any means to directly measure refining intensity, and it is usually inferred by a parameter called specific edge load (SEL). SEL is usually computed by carefully measuring the total length of the stator and rotor bar edges that will cross in a single revolution. The net applied power divided by the product of the total edge length and the rotational speed yields a value for the specific edge load (usually expressed as watt-seconds per meter).

The two-parameter concept of refining has been viewed in a variety of ways. One such view identifies a first parameter as a measure of the number of impacts that act on an average particle, and a second measure as the intensity of the impact that acts on the average particle. However, all such views depend on the measurement of the edge length of the working surface of the filling and take no account of the extent to which material is in fact captured on the available edge length. Other process variables including the condition of the process material, the condition of the bar edge, the angle of intersection of rotor and stator bars and the flow velocity in the filling, all may have significant effects on the amount of process material actually captured on the edges. Indeed, there are many instances in both pilot plant and commercial experience, where a particular pulp processed under identical conditions of SEC and SEL has exhibited significantly different measured physical characteristics.

Refining intensity has long been considered a parameter of interest in low consistency refining of paper pulps using bar equipped beating devices. It is now generally accepted that the refining effect on pulp in any given refiner is largely determined by the amount of refining (the specific energy consumption, or SEC) and the intensity of refining (the specific edge load, or SEL). Even in comparing the effects of different refiners of different size and process flow, these two parameters have proven to be reasonably predictive of pulp characteristics and the resulting paper properties—at least qualitatively if not quantitatively. They are often described as the "amount" and the 'severity" of refining, respectively.

The calculation methods for the two parameters are simple and they will not be presented here. SEC is arguably a fundamental process variable (energy input per unit mass of moisture free substance). While the energy may be applied more or less efficiently in terms of producing some desired effect, it is conceptually easy to appreciate its potential impact on the refining result. SEL, on the other hand, represents a machine parameter (a function of edge length available and rotational speed rather than a process condition. It is generally presumed to be indicative, at least on a relative basis, of the severity of the stress acting on the fibers in the process. However, it does not account for what may be very large variations in the collection of pulp fibers on bar edges due to such factors as pulp consistency, flow velocities, bar edge sharpness, or degree of refining. In attempting to optimize refiner fillings and operating conditions, it is often not sufficiently predictive to meet the needs of some modern papermaking operations, and it offers no diagnostic help when an unexpected result is realized.

In general, while SEC and SEL are somewhat predictive of the product quality characteristics, a more direct measure of the actual strains applied to the process material would be very useful. It could be used in the diagnosis and control of disk mills, in particular with regard to the design and development of more energy efficient refiner fillings, and with regard to optimizing the operating conditions of the process so as to produce higher quality products.

It has long been recognized that the operating clearance between the rotor and stator will be of significant importance in a disk mill. It is not uncommon in modern commercial chip refining systems to have several refiners equipped with clearance measuring devices. However, the difficulty in maintaining the precision and reliability of the devices, particularly with regard to the zero reference, has made them of limited value in routine diagnosis and control of refiners. Because the bars of the working surface wear continuously and in a very irregular way, and because of the very hostile environment in which they operate, delicate gap measuring instruments are often not reliable.

Nonetheless, operating clearance or gap remains an important operational factor and the present invention takes into account a "delta g" or the change in gap (instead an absolute value for gap) in providing a direct measure for refining intensity.

SUMMARY OF THE INVENTION

We propose a qualitative conceptual model of the microscopic process of fiber cell wall strain occurring in the pulp refining process. Based on the assumptions of this conceptual model, an analysis of the mechanics of the physical model are presented, together with a proposed method for measuring, on a relative basis, the degree of fiber strain that is occurring in a commercial refiner under any given set of operating conditions. This method involves the accurate measurement of operating plate gap and net applied power at the refiner. In addition to facilitating the design and application of plate patterns, this type of measurement could provide valuable real-lime indications of changing pulp characteristics that would allow immediate corrective action to be taken and offset process adjustments to be made downstream.

The unique method of this invention includes a precise measure of the incremental change in the gap of a refiner and a simultaneous precise measure of the related incremental change in the net applied power (or more precisely, in the incremental change in the normal force acting to close the gap). Because it is the incremental change in gap that is of consequence, it is not necessary to have a zero reference. And, since a zero reference is not required, the wear of the fillings is of little consequence. In fact, precise incremental changes in gap can be determined by making precise measurements of the movement of external supporting machine elements thus avoiding any complications due to either filling wear or the hostile process environment.

Specific examples are included in the following description for purposes of clarity, but various details can be changed within the scope of the present invention.

OBJECTS OF THE INVENTION

An object of the invention is to provide a method for diagnosis of a pulp refining mill.

Another object of the invention is to provide a diagnostic parameter for refining intensity in a pulp mill.

Another object of the invention is to provide a direct measure of severity of the stress acting on fibers or refining intensity under any given set of operating conditions in a pulp refining process.

Other and further objects of the invention will become apparent with an understanding of the following detailed description of the invention or upon employment of the invention in practice.

BRIEF DESCRIPTION OF THE DRAWING

A preferred embodiment of the invention has been chosen for detailed description to enable those having ordinary skill in the art to which the invention appertains to readily understand how to practice the invention and is shown in the accompanying drawing in which:

FIG. 1 presents Table 1 detailing load-compression test results of an experiment with reinforced plastic tubing sections to demonstrate that in principle, when compressing bundles of such tubular elements, applied load is approximately proportional to the inverse of displacement. While the scale of length is much smaller for pulp fibers, the general characteristics of load response can be reasonably assumed to be similar.

FIG. 2 is a graph of the test results of FIG. 1.

DETAILED DESCRIPTION OF THE PREFERRED EMBODIMENT

Conceptual Model

Figures 1, 2:
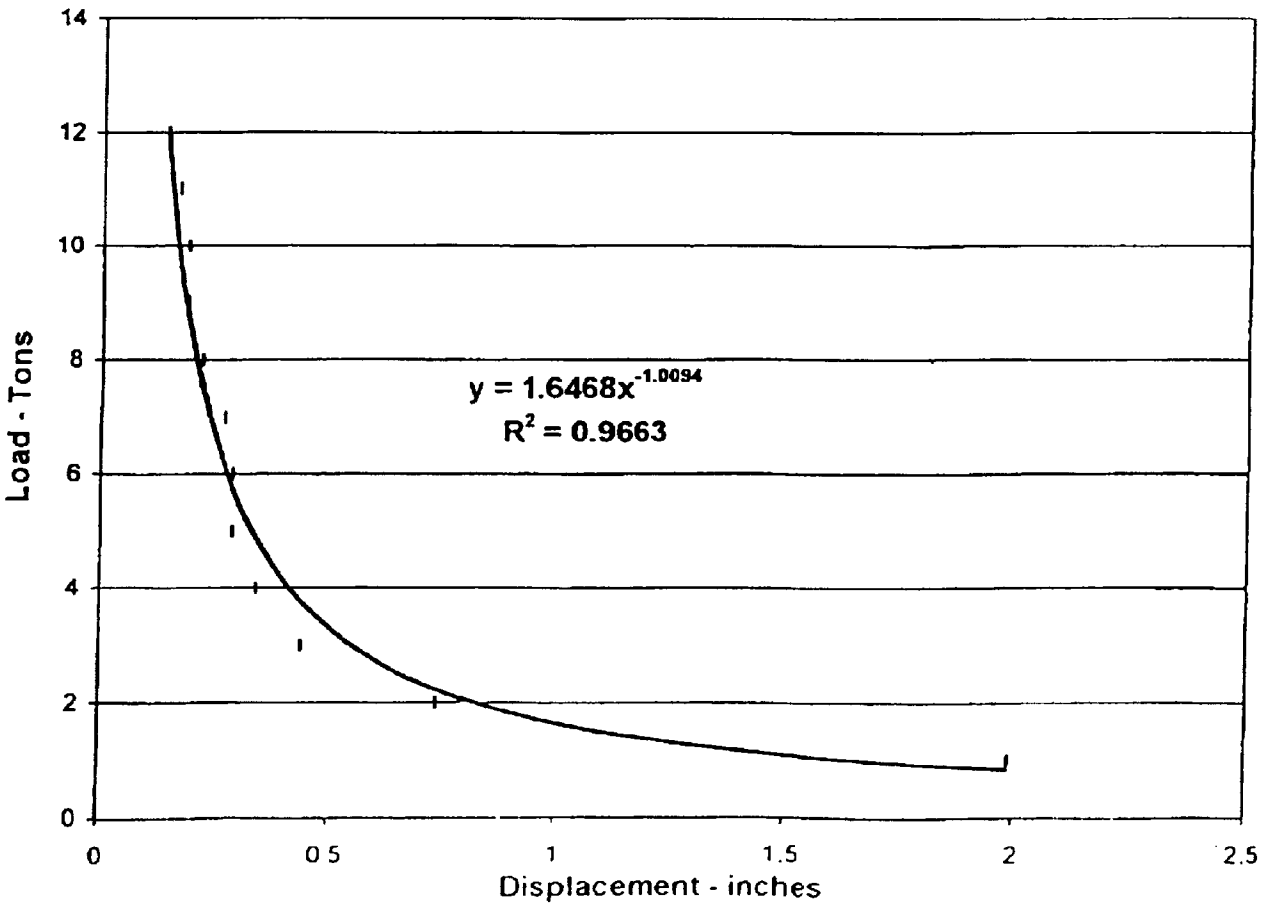

A conceptual model has been established for the method of the present invention based on four underlying assumptions. These assumptions and arguments supporting them follow.

1. All of the observed effects on the constituent fibers of refined pulps occur as a result of the peak compressive load acting on fiber accumulations—just as two opposing bars begin to overlap. The refining process begins with random accumulations of fibers gathering between approaching rotor and stator bar edges, and the consolidation and compression of these fiber accumulations between those edges as they pass each other (these fiber accumulations are commonly referred to as flocs, although the formation and composition of these accumulations is quite different from freely formed flocs in a suspension). It has often been suggested that a significant shear effect may occur between the surfaces of opposing bars in a pulp refiner, but it seems more likely that the great majority of the refining action occurs at the leading bar edges as the plates cross each other and a sudden compression of the floc occurs. Even if the consistency of the fiber flocs being sheared is very high, it is the nature of a compressible material acting under a normal load to further compress under an additional shear load, thus relaxing the normal force component if the compressing surface does not further displace. This is because the plane of principal stress is shifted by the application of shear and the resulting increase in the principal stress causes further deformation. In our opinion, the significance of the bar surfaces is much more likely related to their role as a bearing surface. When the peak compressive load applied at the edge substantially exceeds the capacity of the fully compressed fibrage, then the bar surfaces may act to resist an immediate collapse of the operating gap. Thus, the occasionally observed benefit of wider bars may be explained. There is some evidence to suggest that pulp cannot be refined by the application of shear loads alone. On the other hand, there is considerable evidence to suggest that sufficiently high compressive loads always produce a refining effect on pulp. Finally, if we are interested in peak stresses, it is of course necessary to divide the measured load by the area over which it acts. It seems almost certain that the load bearing area at a bar surface is at least an order of magnitude more than that of the bar edge, and so the stress level on the surface should be very small by comparison.

2. The quality of the refining effect for any single fiber is determined largely by the magnitude of the peak compressive stress occurring in the cell wall, and this is proportional to the average magnitude of the peak compressive stress acting on the accumulation of fibers. Because fibers vary widely in both diameter and cell wall thickness, stress levels will vary widely. Only in those cases where the cross section of a constituent fiber has been strained to cause failure—presumably at the outermost element of the section—will a refining effect occur, However, the higher the peak stress on the accumulation, the higher will be the peak stresses on each of the constituent fibers, and so the peak load on the accumulation can be presumed to be reasonably indicative of relative fiber stress.

3. The magnitude of the peak compressive stress in a fiber floc or accumulation of fibers is proportional to the peak degree of compression of the accumulation during a bar edge crossing event. There is no rigorous argument to support this assumption. Although it is true that certain compressible materials behave according to this relationship, the fiber accumulation is a complex and very heterogeneous structure and its strain behavior is difficult to model. In addition, the strain rate in a refiner bar edge interaction is extremely high. Dynamic effects may predominate. Nevertheless, the inventors have performed a crude experiment with a collection of reinforced plastic tubing sections arranged to simulate a collection of fibers draped over a bar edge. The tubing dimensions reflected a scale factor of about 2500 for the fibers and bar geometry, and the simulated bar edge reflected a radius of about 60 $\mu$m. The tubing sections were arranged more or less parallel, about three deep, and spread along a bar length of about 10 tubing diameters. The load-compression results of this very simple test are shown in Table I appearing in FIG. 1. If the zero reference is adjusted by an amount equal to the fully compressed collection, then the applied load is approximately proportional to the inverse of the displacement. See FIG. 2. An additional piece of empirical evidence supporting this assumption is our repeated observation (different refiners, fillings and pulp types) that a linear regression of net power on 1/gap (with an appropriate selection of the zero reference) yields a very high degree of correlation. The degree of floc compression can be expressed as the ratio of the uncompressed to the compressed dimension of the accumulation (measured in the direction of compression). As with the simple tubing experiment, it may be that the inferred gap based on our measurements is less than the actual gap by an amount equal to the height of the fully compressed fiber accumulation.

4. The magnitude of the peak compressive stress in an accumulation of fibers is proportional to the magnitude of the peak compressive load acting on that accumulation divided by the effective load bearing area. This area is assumed to be proportional to the product of the bar edge radius and some relative measure of the uncompressed accumulation. Although the relationship between load and stress is obvious, the assumption regarding area may not be. Since we are interested in the component of load which acts along a vector between the two opposing bar edges as they approach and cross, we must make a reasonable assumption regarding those variables which determine the area over which that load is distributed. It seems reasonable to assume that if the load is applied at the edge, the radius of curvature of the edge will determine one linear component of the area calculation, reflecting the extent to which the load is "spread" over the edge. The other linear component should reflect the extent to which the load is "spread" along the edge on either side of the line of action of the load. It is easy to imagine that the extent of spreading may depend very much on the intersecting angle. However, for a given geometry at the vertex, the extent of load distribution along the edge should be largely determined by the amount of fiber collected on the edge, and this can be expressed by a measure of the average size of the floc that gets caught at the vertex.

Mathematical Model

Assumptions 1 and 2 above define the overall physical arrangement of load application to the constituent fibers of a pulp as it is processed in a typical commercial refiner. Assumption 3 allows us to express the stress in a fiber accumulation, and in its constituent fibers, as a function of the floc strain as follows:

$$\sigma_a = c_1(h_o/h)$$

where $\sigma_a$ represents the stress in a fiber accumulation at a bar crossing point, $h_0$ and h represent the uncompressed and compressed heights respectively of the fiber accumulation at that crossing point, and $c_1$ is a constant of proportionality. This constant of proportionality should be dependent only on material properties, reflecting a relative stiffness of the fiber accumulation (such as fiber species, pulping process and degree of refining).

Assumption 4 allows us to express the relationship between the applied load and the stress by the equation:

$$\sigma_a = c_2 f_{nc}/(h_o/r_e)$$

where $f_{nc}$ is the net compressive force acting on the accumulation, along the vector described previously and $r_e$ is the effective radius of the bar edge. Again, $h_o$ is a measure of the size of the floc at the crossing point and therefore reflects the extent to which the load $f_{nc}$ is distributed along the edge while $r_e$ reflects the extent to which it is distributed over the edge.

These two equations can be combined to define the load acting at each bar edge crossing point:

$$f_{nc} = c_1 c_2 r_e (h_o^2/h)$$

According to this expression, the load acting on the fiber accumulation at the crossing point of a rotor bar edge and a stator bar edge (for a given edge radius condition) depends only on the uncompressed and compressed heights of the accumulation. Only those process variables affecting the accumulation of fiber on edges (such as consistency or flow velocity) will change the crossing point load if the value of h is not changed.

While it may not be possible to measure individual loads at individual crossing points in a refiner, the cumulative effect of the individual loads are the resultant axial and torsional loads, and those can be measured. The force $f_{nc}$ can be resolved into its axial and tangential components. If we are correct in our assumption that the refining effect occurs predominantly at bar edges, then the axial and tangential components should be about equal. Nevertheless, without knowing the precise geometry of the force resolution, we can say:

$$f_{net} = c_3 f_{nc}$$

where $f_{net}$ is the tangential component and $c_3$ is the resolving coefficient which may depend mostly on the radial angles of the rotor and stator bars at the crossing point.

If each tangential load component is multiplied by the radius at that particular crossing point, and if these values are summed, the resultant sum is the total torque applied to the refiner shaft:

$$T = \Sigma_{(n=1,x)} f_{net} r_n$$

where X is the total number of crossing points for the particular refiner filling being used. An approximate value for X for any combination of rotor and stator plates can be obtained with the following equam (.U 0.45

$$\cos \alpha+\beta)(D^2-d^2)/(s_1\ s_2)$$

where $\alpha$ is the average radial angle of the stator bars, $\beta$ is the average radial angle of the rotor bars, d and D are the inside and outside diameters of the active surface, and $s_1$ and $s_2$ are the edge to edge distances for the stator and rotor bar patterns respectively.

If we further assume:

a) that $f_{net}$ is not radially varying (it probably does vary slightly due to the uniform wear constraint imposed by the mechanics of a disk refiner—but this fact does not materially affect the outcome of our analysis);

b) that the number of crossing points at any radius is proportional to the radius for constant edge-to-edge distance between bars; and c) that the bars extend from an inside diameter of d to an outside diameter of D, then the resultant torque is expressed as follows:

$$T=c_3\times f_{nc}(D+d)/4$$

And the resultant power P, is defined as:

$$P=k_1RPM\ T$$

where RPM is the shall speed of the refiner and $k_1$ is the appropriate constant for the units of measure.

According to the above equations, the power applied to a disk refiner can be related to the uncompressed height of the fiber accumulation and the height to which it has been reduced by the compressive load of refining:

$$P=k_1RPM[(D+d)/4]\times c_1c_2c_3r_e(h_o/h)$$

If we now assume now that the operating plate gap, g, in a refiner is proportional to the value of h (with $C_4$ as the constant of proportionality), then the power can be expressed in terms of the gap as follows:

$$P=k_1RPM[(D+d)/4]\times c_1c_2c_3c_4r_e(g_o^2/g)$$

$$\text{Then, } dP/dg=-k_1RPM[(D+d)/4]\times c_1c_2c_3c_4r_e(g_o^2/g).$$

Of particular interest is the fact that, according to the assumptions and development of the model:

$$P/(dP/dg)=-g$$

It should be remembered that $c_1$ $c_2$ $c_3$ $c_4$ are constant only for certain conditions, $c_1$ being dependent on the compressibility characteristics of the fiber accumulation, $c_2$ relating edge radius and floc size to load bearing area, $c_3$ being mostly a function of the rotor bar angle, and $c_4$ depending on specific geometry at the intersecting points.

Model Application

According to the relationship implied by this model, the power applied to a disk refiner will vary with the inverse of plate gap. There is growing empirical evidence to support the fact that this is so. We have measured the relative changes in plate gap and applied power in several tests with different pulps in refiners of differing size and different process conditions. In all these cases, it has been possible to accurately determine the absolute value of net applied power by very carefully measuring no-load power. No attempt has been made to measure absolute gap, but gap changes during a loading cycle have been carefully measured.

In fact, it is very difficult to precisely measure absolute operating gaps in a low consistency, double disk pulp refiner. First, the gaps are exceedingly small—in the order of 0.01–0.02 mm for hardwood pulps. This is much smaller than the variations due to run-out and out-of-tram misalignments in a refiner with a new set of plates. Therefore, accurate gap measurements can only be made after plates are well worn in. But by the time the plates are worn in, a reliable zero gap reference is usually not possible.

Short-term gap changes, however, are quite easy to measure and with a high degree of precision, (in a double disk, floating rotor machine, operating conditions must favor a hydraulically balanced rotor). It is only necessary to precisely measure the displacement of the sliding head and to divide by the number of gaps represented (two in the case of a double disk refiner). For For tment of gap changes, a precision of 0.005 mm is possible, and it can be done at any point in the wear cycle of a set of refiner plates after initial wear-in.

The experimental determination of the power-gap curve for a given set of process conditions is quite simple. One of the most reliable methods of determining gap changes is to count the degrees of revolution of the input worm gear on the refiner actuating mechanism. So long as the motion is in only one direction to avoid backlash error, and the threads of the main thrust screw are not excessively worn, this is a precise indicator of gap changes. A precise value of the no-load power at the existing wear condition of the refiner plates must be known and a precise value of the motor load must be recorded after each measured incremental gap change.

Once the power and corresponding gap measurements have been made, a regression analysis is used to "smooth" the data and generate an equation of power as a function of gap. This equation can then be differentiated to determine the slope at any power level. At each recorded power level, the actual operating gap g (according to the above model) can be determined by dividing the power reading by the calculated slope. And, since all the coefficients remain constant in the power equation, go can be calculated from that equation.

If our assumptions are correct, the average stress level in the fibers is reflected by the average stress level in the accumulations, and is proportional to $g_o/g$.

We would propose that the calculated value of $g_o/g$ is very good indication of the relative refining intensity in any operating refiner given a particular type of pulp and degree of refining. It remains to be seen, for this particular ratio, what is the sensitivity to degree of refining and to what extent can we include degree of refining in the expression for actual refining intensity.

Experimental Results

Attached Attached 3 is a Table II that lists the data recorded and the subsequent calculations for a recent experiment with two side-by-side 38" double disk refiners, comparing two sets of refiner fillings with very different edge lengths and SEL values. The "MD Filling" was a Multi-Disk refiner filling with a 1.0–2.0 bar pattern. The "FB Filling" was a fine Double Disk refiner filling with a 1.0–1.3 bar pattern. The regression show in FIG. 4 was done using the presumed 1/g relationship. The zero reference was varied in an iteration to force the exponent of the power transform to a value of −1 in the linear regression. However, it is not necessary to do this. Any transformation may be used so long as it results in a high $R^2$ value and results in an equation that is mathematically differentiable.

Figures 3, 5:
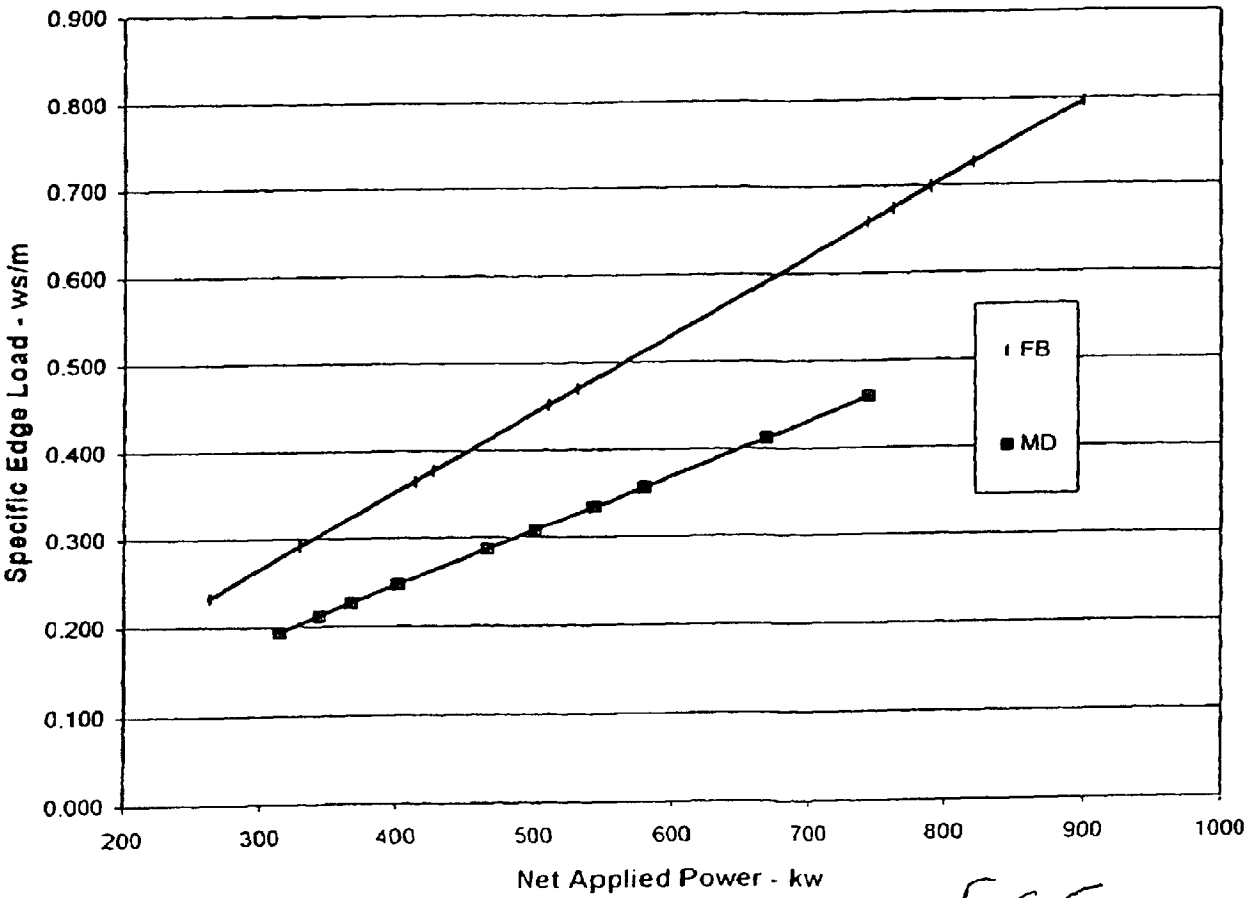
FIG. 3 presents Table II which records data comparing different refiner fillings at different conditions of plate position and applied power.
FIG. 5 is a graph of Specific Edge Load (SEL) for two different refiner fillings.
Figure 6:
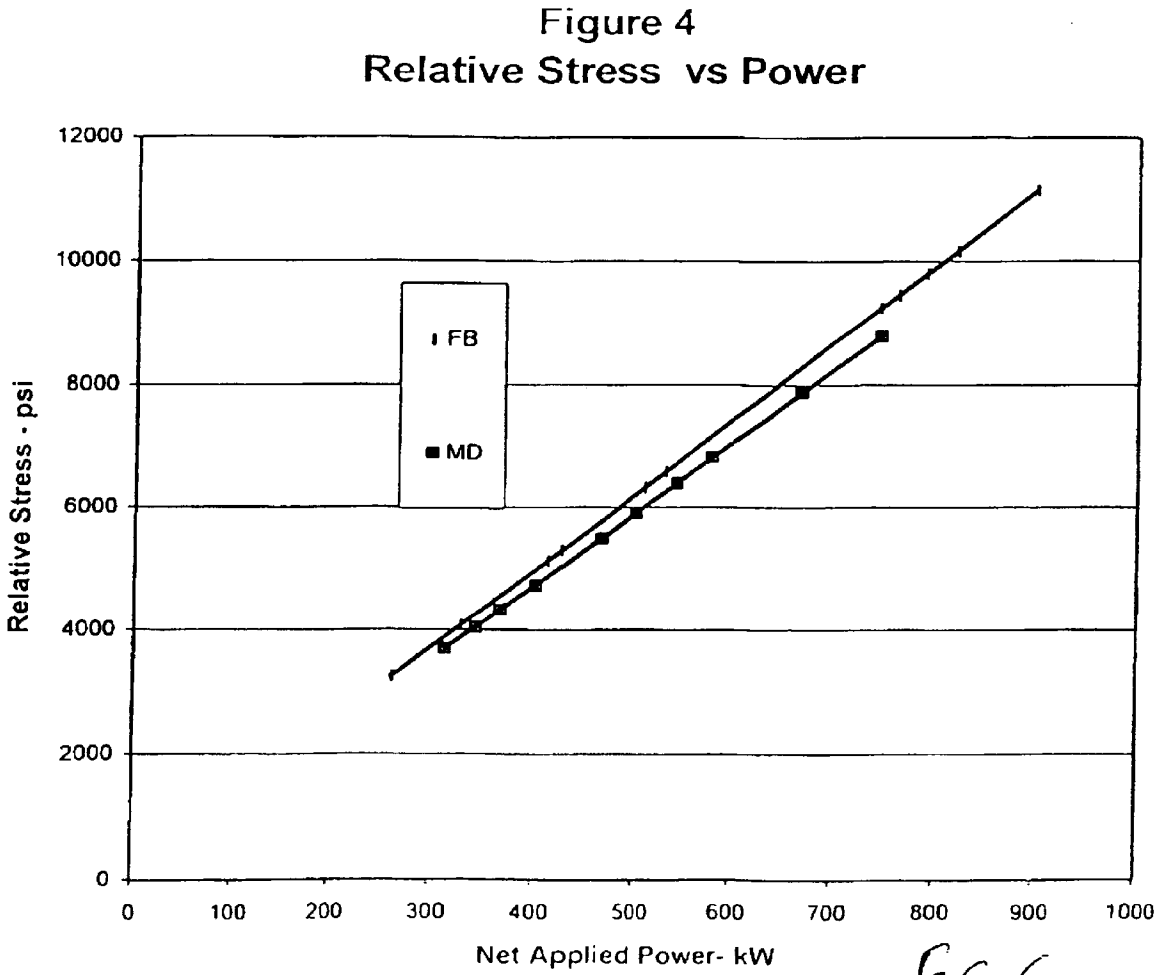
FIG. 6 is a graph of relative stress vs power of the fillings of FIG. 5.

The throughput rate of hardwood kraft was identical for both refiners. As seen in FIG. 5, the SEL values for the two fillings were appreciably different for any net applied power level. However, the calculated relative stress based on measured power and gap changes (FIG. 6) are nearly identical. In fact the results of pulp tests (TABLE III and FIGS. 5–12) could not distinguish between the two refiners despite the fact that the difference in SEL should have caused significant and measurable difference in pulp properties.

Referring to FIG. 3 (the spreadsheet Table II) which shows the recorded power and handwheel rotations for each of two side-by-side 38" disk refiners in a papermill producing copy paper. One machine had a filling referred to as an FB filling which had a full filling edge length of about 133 km per revolution, and was a double disk type with a refining zone on each side of a single rotor turning at 510 RPM. The second machine, otherwise identical to the first, had a filling referred to as an MD filling which had a full filling edge length of about 191 km. It was a three-rotor filling with a total of six refining zones, also operating at 510 RPM. The FB filling had a no-load power of 150 kw and the MD filling a no-load power of 300 kw. The test was performed primarily to ascertain the extent to which the paper quality would be diminished by refining at the higher specific edge load of the FB filling. A significant reduction in the quality was expected by the relative difference in SEL, assuming that SEL is a satisfactory measure of refining intensity. Subsequent testing of pulp samples taken at each recorded power level indicated little if any difference between the two fillings, and as will be seen below, this may be explained by the use of the new measure of refining intensity which is the subject of this invention.

For each filling, there is a listing above each table showing the no-load power, the total filling edge length, the rotor outside and inside diameters, the RPM, the total crossing point value X, and the assumed values for the several earlier described constants $K_1$, $c_1$, $c_2$, $c_3$, and the edge radius $r_e$. The constants and the edge radius were assumed identical for both fillings given that the bar material was the same in both cases, and the pulp being processed was identical.

The main body of the data tabulations for each filling contains several columns. The first column is the recorded motor load in kilowatts. The second column is the cumulative degrees of handwheel rotation which, in the spreadsheet, is automatically adjusted by the addition of an "assumed zero" value above the column. This assumed zero is manipulated so that regression equation of an assumed form, $P=b*1/g^n$, produces a fit line for a value of n=1. This then defines the appropriate gap-power relationship. It infers that the power approaches an infinite value as the gap approaches zero, although in reality the pulp flocs become increasingly "sheared off" rather than compressed as the load gets excessive, and this becomes obvious by the well-known drop in measured power as the gap gets too small.

The third column is the calculated gap based on the handwheel revolution (adjusted for the assumed zero value), and is the value of gap used in the trial regressions. The fourth column is the net power consumed by a single disk pair (one refining zone), and is calculated from the measured gross power, first by subtracting the no-load power for that filling, and then dividing the result by the number of disk pairs (or refining zones). This is the value of power used in the trial regressions.

The fifth column is a calculated value of power based on the gap the of column three, using the general form of the gap power equation described above, and using a value for b derived from the regression iteration.

Column six is the result of the mathematical integration of the power equation resulting from the regression, showing the dP/dg value for each value of gap in column three.

The seventh column is a gap value which is calculated by dividing the single pair power of column four by the dP/dg value of column six. As can be seen it conforms closely to the measured gap (adjusted for the assumed zero) except at the extremes.

Column eight is the calculated value for $g_o$ based on the equations of the proposed model, using the assumed values for the constants.

The relative stress shown in column eight is calculated from the ratio of go/g according to the equations of the model and the assumed constants. While the true absolute value of average stress in the fiber wall is highly dependent on the assumed values of certain constants, the relative comparison for two fillings acting on the same pulp, is according to this invention, a much more valid indicator of relative refining intensity compared with SEL.

Columns nine and ten show the net value of applied power (being the measured total power less the no-load power), and the Specific Edge Load (SEL, in watt seconds per meter), for each power point, for each filling.

Figure 4:
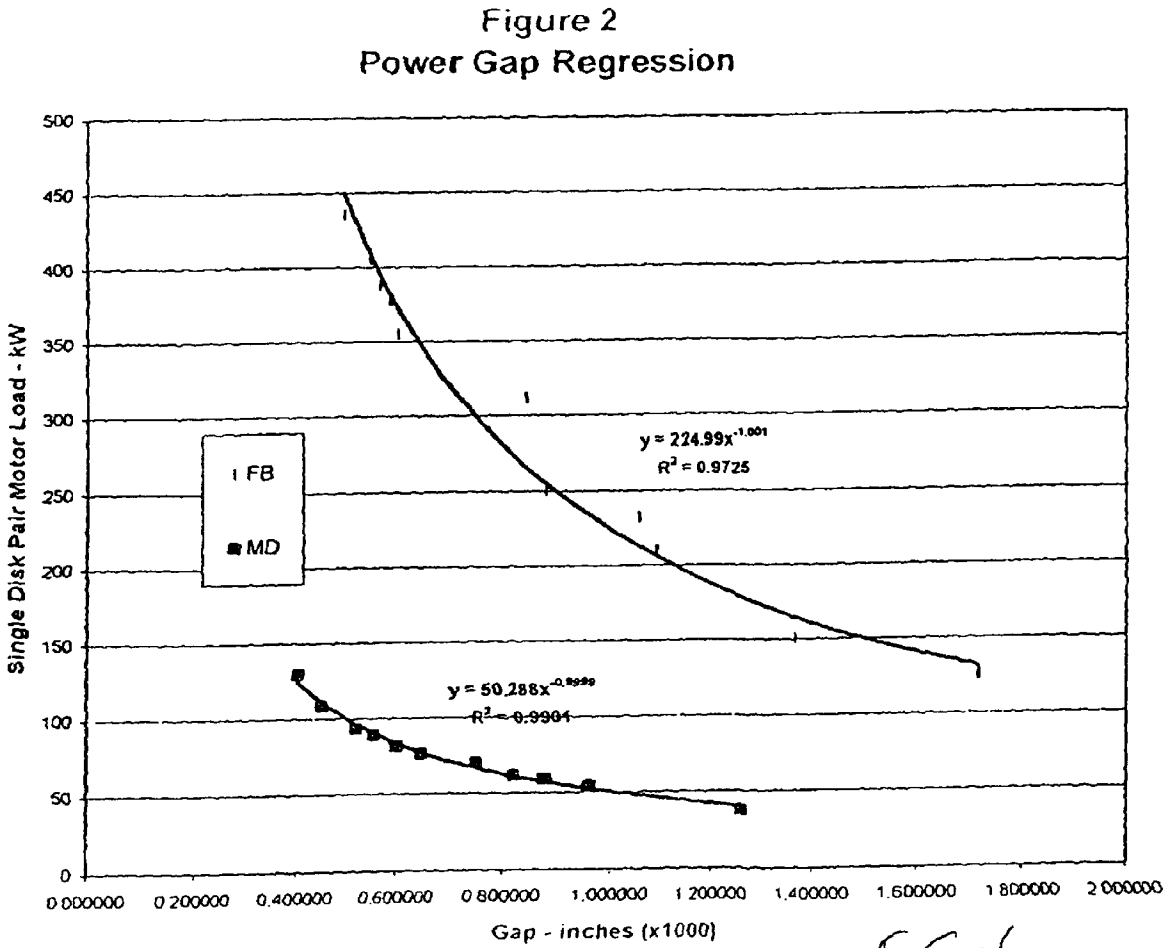
FIG. 4 is a graph of the data of FIG. 3.

As indicated in FIGS. 4 and 5, and with the knowledge that the pulp properties were essentially identical for both fillings, the Relative Stress was a much better predictor of pulp properties than was the calculated SEL.

A succinct statement of a method according to the invention is that of indirectly determining the operating gap of a disk mill by performing a series of measurements of the incremental displacement of the stator element (or elements) of the mill and the resulting incremental change in motor load, then performing an iteration by regression to arrive at a solution for the constant $b_o$, and a zero reference position, that causes a high degree of fit of the measured data to the equation $power=b_o\times 1/gap_n$, describing the general form of the inverse relationship between operating gap and applied power for a known value of the exponent n. The value for n is a direct inverse of the relationship of $\Delta p/\Delta g$. For pulp refining, n can be reasonably valued at 1.

An instrument (patent rights reserved) is currently being constructed which will facilitate monitoring of power and plate gap changes in mill operating refiners. It is expected that, over a period of time, a large database of power-gap relationships will be generated. To the extent possible, information regarding pulp type and condition, average flow velocities, intersecting angles, edge radii, and bar patterns will be included. This should lead to improved methods for designing and applying plate patterns in stock prep applications. It is also possible that permanently installed power-gap measuring devices could provide valuable real time indications of changing pulp characteristics which would allow immediate corrective action to be taken, and offsetting process adjustments to be made downstream.

Thus it is possible in many pulp and paper mill installations to quite simply retrofit the appropriate sensing devices to determine changes in refiner filling gap. And, many such mills have relatively precise measure of refiner motor load available within the existing mill DCS system. All that is required to implement this method is to add a rotation counting device to the refiner, and to generate the table of power and position values recorded during a single loading cycle. It is possible to automatically program such cycles so as to repeat at regular time intervals, thus providing a semi-continuous indication of real refining intensity.

Various changes may be made to the method embodying the principles of the invention. The foregoing embodiments are set forth in an illustrative and not in a limiting sense. The scope of the invention is defined by the claims appended hereto.

We claim:

1. A method of determining the actual operating gap (−g) in an operating disk pulp mill comprising the steps of recording a power level (P), recording the changes in gap (Δg) and change in power (ΔP) at said power level and determining the actual operating gap from the formula $P/(\Delta P/\Delta g)=-g$.

2. A method of indirectly determining the operating gap of a disk mill comprising the steps of performing a series of data measurements of the incremental displacement of the stator element (or elements) of the mill and the resultant change in motor load, performing an iteration by regression to arrive at a solution for the constant $b_o$, and a zero reference position that causes a high degree of fit of the measured data to the equation $power=b_o\times 1/gap^n$ which describes the general form of the inverse relationship between operating gap and applied power for a known value of the exponent n.

3. A method as defined in claim 2 in which the value of n is reasonably estimated as 1.

4. A method of measuring degree of floc compression in an operating disk pulp refiner comprising the steps of measuring operating clearance $g_o$ of the operating disks at motor no-load condition, measuring the operating clearance (g) of the operating disks at a motor load condition, and inferring from the ratio of $g_o/g$ the degree of floc compression at the motor load condition.

5. A method for measuring relative stress in floc in an operating disk pulp mill comprising the steps of measuring no load power to the mill, measuring incremental gap changes during a loading cycle while simultaneously measuring a value of net power after each measured incremental gap change, calculating relative stress in floc at a point in the load cycle as a product of net applied power and the ratio $g_o/g$ where $g_o$ is no-load gap and g is gap at said point in the load cycle.

6. A method for determining relative stress in pulp fibers in an operating disk pulp mill comprising the steps of measuring change in operating clearance between operating disks while measuring change in normal force producing change in operating clearance and inferring pulp stress from inverse relationship between measured changes in operating clearance and normal force.

7. A method for determining refining intensity in an operating disk pulp mill comprising the steps of measuring no load power to the mill, measuring incremental gap changes during a loading cycle while simultaneously measuring a value of motor load after each measured incremental gap change, correlating gap changes and motor load to determine an equation of power as a function of gap, and using the ratio $g_o/g$ where $g_o$ is no-load gap and g is gap at a point in the load cycle as an index of refining intensity.

8. A method for determining refining intensity in an operating disk pulp mill having a sliding head comprising the steps of measuring no load power to the mill, measuring incremental gap changes by measuring displacement of the sliding head during a loading cycle while simultaneously measuring a value of motor load after each measured incremental gap change, correlating gap changes and motor load to determine an equation of power as a function of gap, and using the ratio $g_o/g$ where $g_o$ is no-load gap and g is gap at a point in the load cycle as an index of refining intensity.

9. A method for determining refining intensity in an operating disk pulp mill having a refiner actuating mechanism comprising the steps of measuring no load power to the mill, measuring incremental gap changes by counting degrees of revolution of the refiner actuating mechanism during a loading cycle while simultaneously measuring a value of motor load after each measured incremental gap change, correlating gap changes and motor load to determine an equation of power as a function of gap, and using the ratio $g_o/g$ where $g_o$ is no-load gap and g is gap at a point in the load cycle as an index of refining intensity.

* * * * *